US010252401B2

(12) United States Patent
Lucas

(10) Patent No.: US 10,252,401 B2
(45) Date of Patent: Apr. 9, 2019

(54) CLAMPING AND SPREADING DEVICE

(71) Applicant: Chris Lucas, Humble, TX (US)

(72) Inventor: Chris Lucas, Humble, TX (US)

( * ) Notice: Subject to any disclaimer, the term of this patent is extended or adjusted under 35 U.S.C. 154(b) by 215 days.

(21) Appl. No.: 15/445,314

(22) Filed: Feb. 28, 2017

(65) Prior Publication Data

US 2018/0243886 A1 Aug. 30, 2018

(51) Int. Cl.

| | |
|---|---|
| ***B25B 5/10*** | (2006.01) |
| ***B25B 27/02*** | (2006.01) |
| ***B25B 5/00*** | (2006.01) |

(52) U.S. Cl.

CPC ..... *B25B 5/101* (2013.01); *B25B 5/003* (2013.01); *B25B 27/023* (2013.01)

(58) Field of Classification Search

CPC ..... B25B 5/003; B25B 5/16; B25B 5/101; B25B 5/067; B25B 5/109; B25B 5/10; B25B 27/14

See application file for complete search history.

(56) References Cited

U.S. PATENT DOCUMENTS

| | | | | |
|---|---|---|---|---|
| 2,221,397 | A * | 11/1940 | Fluhr | B25B 5/003 269/110 |
| 4,257,584 | A | 3/1981 | Sterling | |
| 6,554,264 | B1 | 4/2003 | Alford | |
| 6,745,006 | B2 | 6/2004 | Thomas | |
| D557,582 | S | 12/2007 | Murray et al. | |
| 7,896,323 | B2 | 3/2011 | Murray | |
| 8,240,647 | B2 | 8/2012 | Geier et al. | |
| 9,156,138 | B1 | 10/2015 | Prescott | |
| 2014/0265084 | A1 | 9/2014 | Evatt et al. | |

* cited by examiner

*Primary Examiner* — David B. Thomas

(57) ABSTRACT

A clamping and spreading device for separating layers of a substrate includes a C-clamp that is configured to fixedly couple to a substrate. A second rod is coupled to and extends from the C-clamp. The second rod is selectively extensible from the C-clamp. A first wedge is coupled to and extends bidirectionally from the second rod distal from the C-clamp. A second wedge is coupled to and extends from the C-clamp. An actuator is coupled to the C-clamp and is operationally coupled to the second rod. The first wedge and the second wedge are configured to insert into a first gap defined by two layers of the substrate. The actuator is positioned to compel the second rod to extend from the C-clamp. The first wedge is compelled distally from the second wedge to separate the two layers of the substrate.

16 Claims, 4 Drawing Sheets

CLAMPING AND SPREADING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to clamping and spreading devices and more particularly pertains to a new clamping and spreading device for separating layers of a substrate.

BRIEF SUMMARY OF THE INVENTION

An embodiment of the disclosure meets the needs presented above by generally comprising a C-clamp that is configured to fixedly couple to a substrate. A second rod is coupled to and extends from the C-clamp. The second rod is selectively extensible from the C-clamp. A first wedge is coupled to and extends bidirectionally from the second rod distal from the C-clamp. A second wedge is coupled to and extends from the C-clamp. An actuator is coupled to the C-clamp and is operationally coupled to the second rod. The first wedge and the second wedge are configured to insert into a first gap defined by two layers of the substrate. The actuator is positioned to compel the second rod to extend from the C-clamp. The first wedge is compelled distally from the second wedge to separate the two layers of the substrate.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
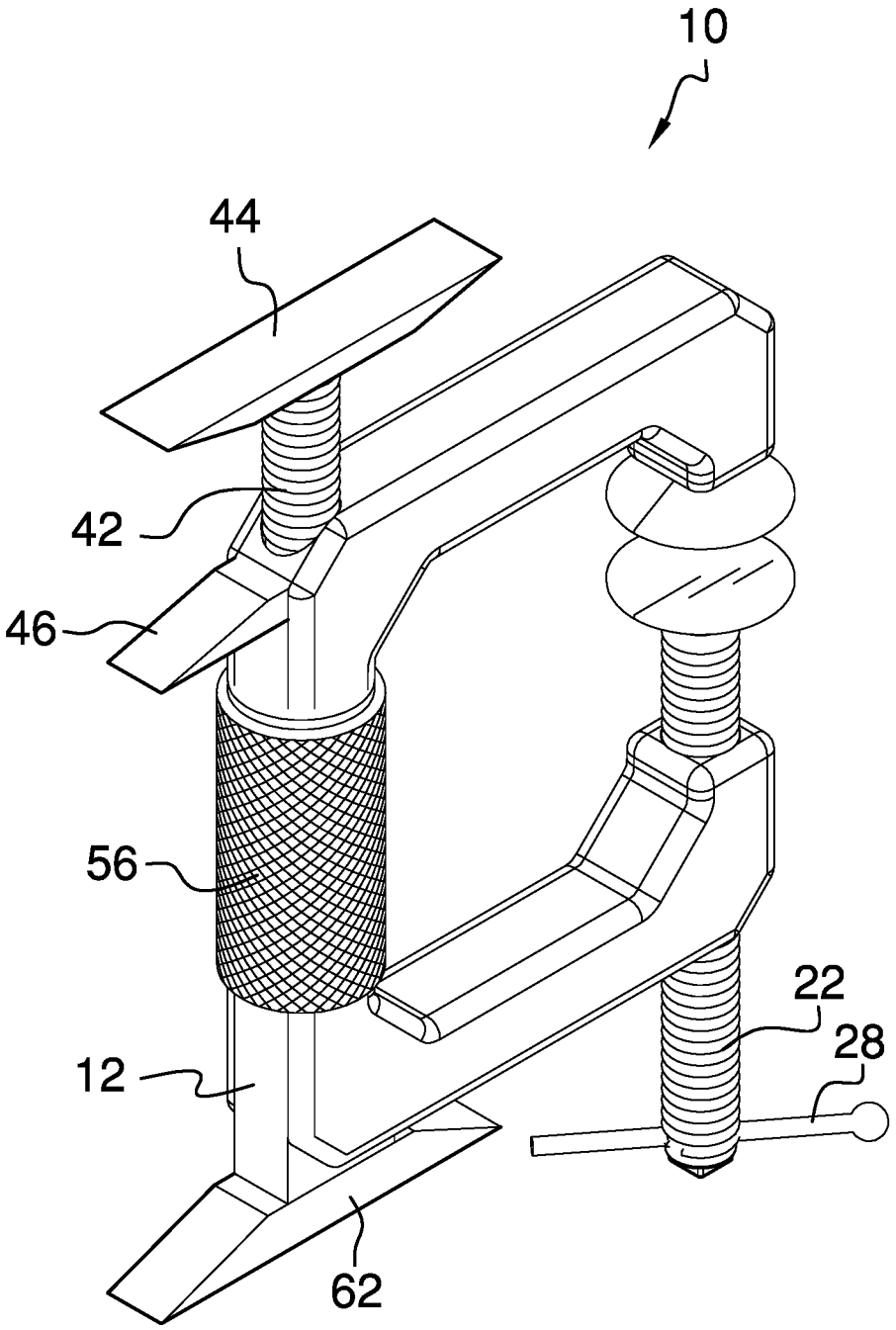
FIG. 1 is an isometric perspective view of a clamping and spreading device according to an embodiment of the disclosure.
Figure 2:
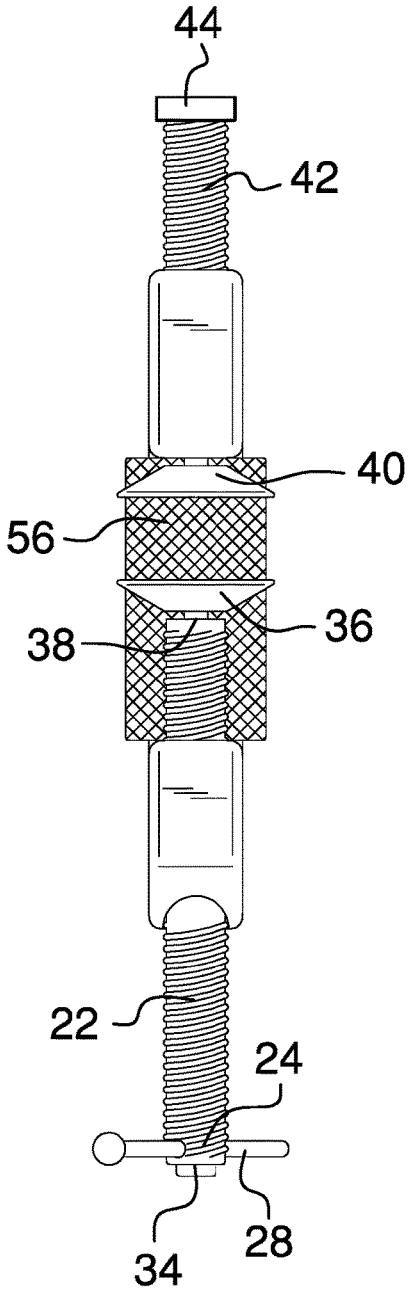
FIG. 2 is a back view of an embodiment of the disclosure.
Figure 3:
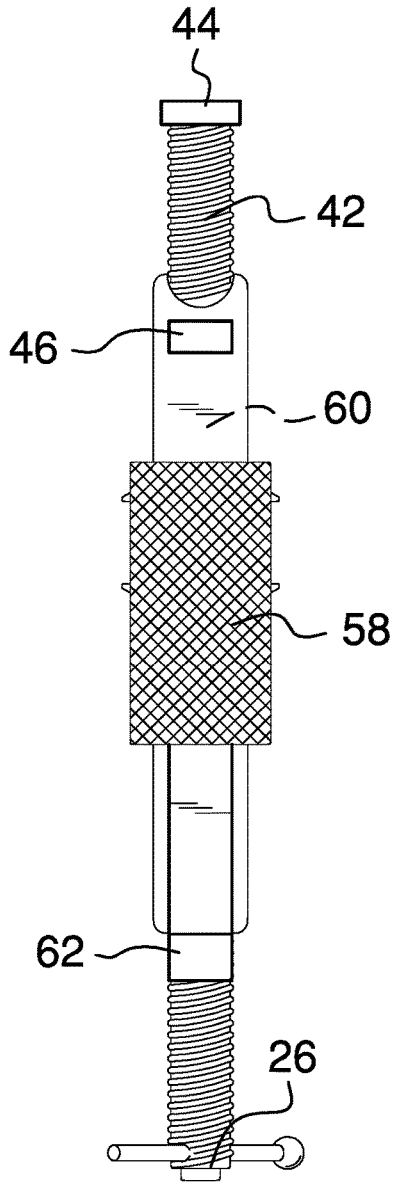
FIG. 3 is a front view of an embodiment of the disclosure.
Figure 4:
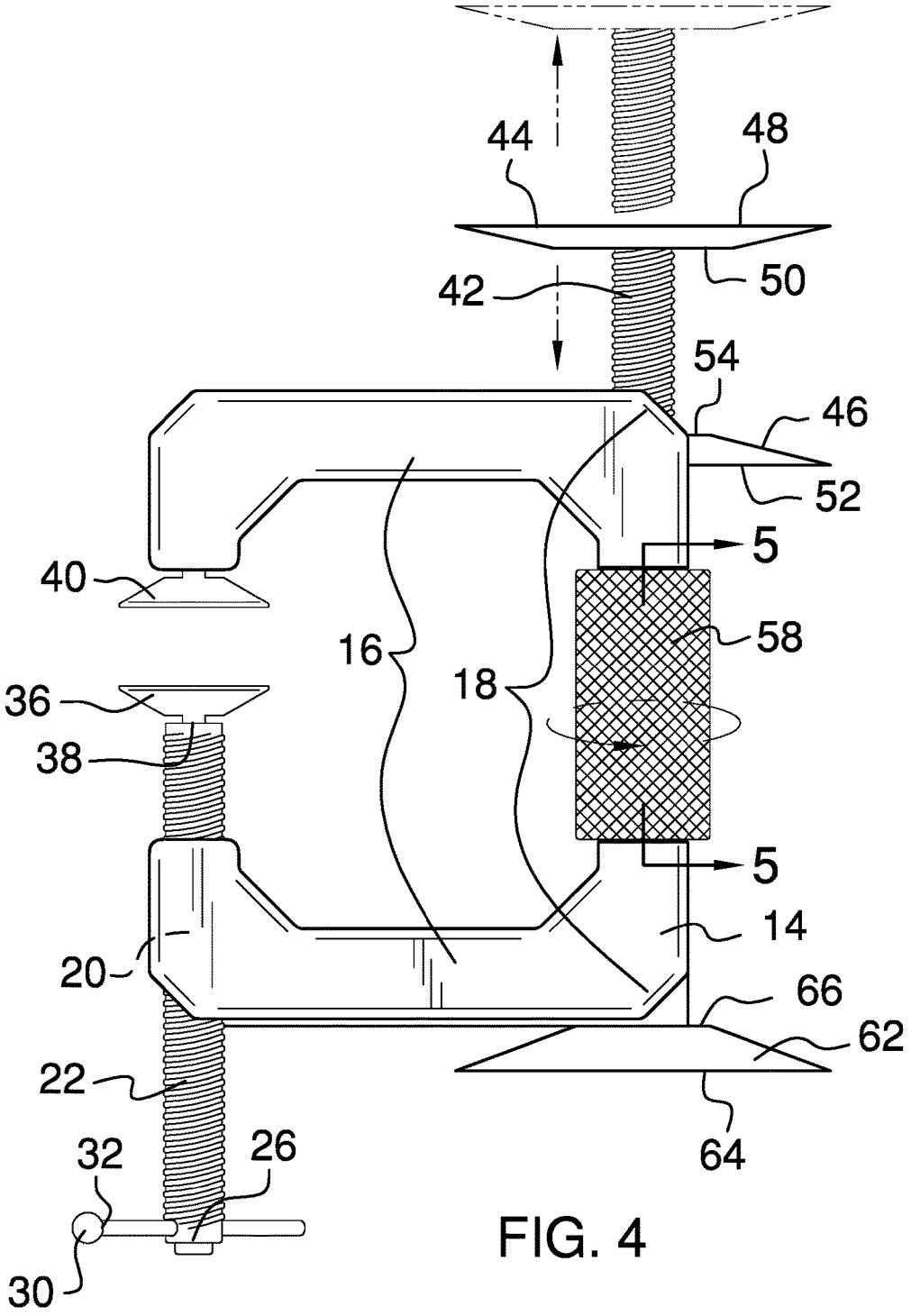
FIG. 4 is a side view of an embodiment of the disclosure.
Figure 5:
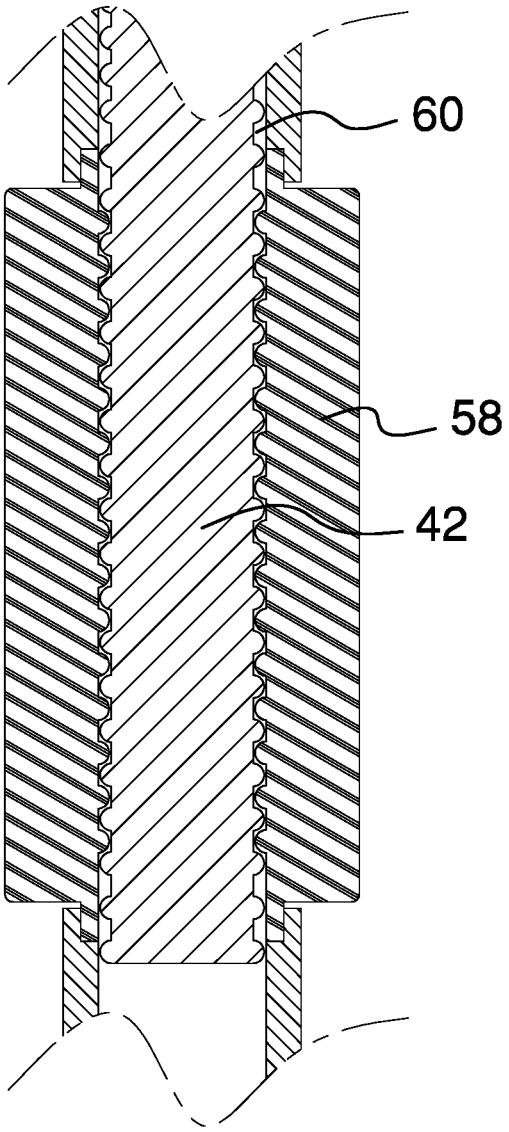
FIG. 5 is a cross-sectional view of an embodiment of the disclosure.

With reference now to the drawings, and in particular to FIGS. 1 through 5 thereof, a new clamping and spreading device embodying the principles and concepts of an embodiment of the disclosure and generally designated by the reference numeral 10 will be described.

As best illustrated in FIGS. 1 through 5, the clamping and spreading device 10 generally comprises a C-clamp 12 that is configured to fixedly couple to a substrate. The C-clamp 12 comprises a first bar 14 and a pair of second bars 16. Each second bar 16 is coupled to and extends perpendicularly from a respective opposing end 18 of the first bar 14. The first bar 14 and the pair of second bars 16 are substantially C-shaped.

A first channel 20 is positioned through a respective second bar 16 distal from the first bar 14. The first channel 20 is parallel to the first bar 14. The first channel 20 is internally threaded. A first rod 22, which is complementary to the first channel 20, is selectively threadedly positionable within the first channel 20 and selectively extendable from the respective second bar 16. The first rod 22 is configured to be rotated so that the first rod 22 is compelled through the first channel 20 to contact the substrate. The substrate is coupled between the first rod 22 and a respective second bar 16.

In one embodiment, a second channel 24 is positioned through the first rod 22 proximate to a first end 26 of the first rod 22. The second channel 24 is positioned to selectively insert a pin 28. The pin 28 extends perpendicularly from the first rod 22. The pin 28 is configured to be grasped and twisted to compel rotation of the first rod 22. In another embodiment, a ball 30 is coupled to a terminus 32 of the pin 28. The ball 30 is positioned to contact the first rod 22 as the pin 28 is positioned through the second channel 24.

In another embodiment, a nut 34 is coupled to the first end 26 of the first rod 22. The nut 34 is complementary to a ratchet. The nut 34 is configured to couple to the ratchet such that the ratchet is positioned to compel rotation of the first rod 22.

A first plate 36 is coupled to and extends from a second end 38 of the first rod 22. The first plate 36 is configured to swivel relative to the first rod 22. A second plate 40 is coupled to and extends from a respective second bar 16. The second plate 40 is opposingly positioned relative to the first plate 36. The second plate 40 is configured to swivel relative to the respective second bar 16. The first plate 36 and the second plate 40 are configured to abut the substrate as the first rod 22 is compelled through the first channel 20 to couple the C-clamp 12 to the substrate. In one embodiment, the first plate 36 and the second plate 40 are circularly shaped.

A second rod 42 is coupled to and extends from the C-clamp 12. The second rod 42 is selectively extensible from the C-clamp 12. In one embodiment, a third channel 60 is positioned longitudinally in the first bar 14. The third channel 60 extends from a respective opposing end 18 of the first bar 14. The second rod is positioned in and extensible from the third channel 60.

A first wedge 44 is coupled to and extends bidirectionally from the second rod 42 distal from the C-clamp 12. A second wedge 46 is coupled to and extends from the C-clamp 12. The second wedge 46 is positioned proximate to a respective opposing end 18 of the first bar 14. The first wedge 44 and the second wedge 46 are configured to be inserted into a first gap defined by two layers of the substrate. In one embodiment, the first wedge 44 is tapered such that an outside surface 48 of the first wedge 44 is dimensionally larger than an inside surface 50 of the first wedge 44. In another embodiment, the second wedge 46 is tapered such that a lower surface 52 of the second wedge 46 is dimensionally larger than an upper surface 54 of the second wedge 46.

An actuator 56 is coupled to the C-clamp 12. The actuator 56 is operationally coupled to the second rod 42. The actuator 56 is positioned to compel the second rod 42 to extend from the C-clamp 12. The first wedge 44 is compelled distally from the second wedge 46 to separate the two layers of the substrate. In one embodiment, the actuator 56 comprises a tube 58. The tube 58 is rotationally coupled to the first bar 14. The tube 58 is threadedly coupled to the second rod 42. The tube 58 is configured to be rotated relative to the first bar 14 to compel the second rod 42 through the third channel 60. The first wedge 44 is compelled distally from the C-clamp 12 and the layers of the substrate are separated. In another embodiment, the tube 58 is textured so that the tube 58 is configured to be grasped by a user to rotate the tube 58.

In one embodiment, the device 10 comprises a third wedge 62. The third wedge 62 is coupled to and extends from the C-clamp 12. The first wedge 44 and the third wedge 62 are configured to be inserted into a second gap defined by two layers of the substrate. In another embodiment, the third wedge 62 and the second wedge 46 are positioned singly proximate to the opposing ends 18 of the first bar 14. In yet another embodiment, the third wedge 62 is tapered such that a top surface 64 of the third wedge 62 is dimensionally larger than a bottom surface 66 of the third wedge 62. In still yet another embodiment, the third wedge 62 is shaped complementarily to the first wedge 44.

In use, the first plate 36 and the second plate 40 are configured to abut the substrate as the first rod 22 is compelled through the first channel 20 to couple the C-clamp 12 to the substrate. The first wedge 44 and the second wedge 46 are configured to be inserted into the first gap defined by the two layers of the substrate. The first wedge 44 and the third wedge 62 are configured to be inserted into the second gap defined by the two layers of the substrate. The tube 58 is configured to be rotated relative to the first bar 14 to compel the second rod 42 through the third channel 60. The first wedge 44 is compelled distally from the C-clamp 12 and the layers of the substrate are separated.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A clamping and spreading device comprising:

a C-clamp configured for fixedly coupling to a substrate;

a second rod coupled to and extending from said C-clamp, said second rod being selectively extensible from said C-clamp;

a first wedge coupled to and extending bidirectionally from said second rod distal from said C-clamp;

a second wedge coupled to and extending from said C-clamp;

an actuator coupled to said C-clamp, said actuator being operationally coupled to said second rod; and wherein said first wedge is positioned on said second rod and said second wedge is positioned on said C-clamp such that said first wedge and said second wedge are configured for inserting into a first gap defined by two layers of the substrate, wherein said actuator is positioned on said C-clamp such that said actuator is positioning for compelling said second rod to extend from said C-clamp, compelling said first wedge distally from said second wedge, such that the two layers of the substrate are separated.

2. The device of claim 1, further including said C-clamp comprising:

a first bar;

a pair of second bars, each said second bar being coupled to and extending perpendicularly from a respective opposing end of said first bar such that said first bar and said pair of second bars are substantially C-shaped;

a first channel positioned through a respective said second bar distal from said first bar, said first channel being parallel to said first bar, said first channel being internally threaded;

a first rod complementary to said first channel such that said first rod is selectively threadedly positionable within said first channel and selectively extendable from said respective said second bar;

a third channel, said third channel being positioned longitudinally in said first bar, said third channel extending from a respective said opposing end of said first bar, said second rod being positioned in and extensible from said third channel; and wherein said first rod is configured for rotating such that said first rod is compelled through said first channel to contact the substrate, wherein the substrate is coupled between said first rod and a respective said second bar.

3. The device of claim 2, further including a second channel positioned through said first rod proximate to a first end of said first rod, said second channel being positioned for selectively inserting a pin such that said pin extends perpendicularly from said first rod, wherein said second channel is positioned in said first rod such that said second channel is positioned for inserting said pin such that said pin is configured for grasping and twisting for compelling rotation of said first rod.

4. The device of claim 3, further including a ball coupled to a terminus of said pin, wherein said ball is positioned on said pin such that said ball is positioned for contacting said first rod upon said pin being positioned through said second channel.

5. The device of claim 2, further including a nut coupled to said first end of said first rod, said nut being complementary to a ratchet, wherein said nut is positioned on said first rod such that said nut is configured for coupling to the ratchet such that the ratchet is positioned for compelling rotation of said first rod.

6. The device of claim 2, further including said actuator comprising a tube, said tube being rotationally coupled to said first bar, said tube being threadedly coupled to said second rod, wherein said tube is positioned on said first bar such that said tube is configured for rotating relative to said first bar compelling said second rod through said third channel such that said first wedge is compelled distally from said C-clamp such that the layers of the substrate are separated.

7. The device of claim 6, further including said tube being textured such that said tube is configured for grasping by a user for rotating said tube.

8. The device of claim 2, further including a third wedge coupled to and extending from said C-clamp, wherein said first wedge is positioned on said second rod and said third wedge is positioned on said C-clamp such that said first wedge and said third wedge are configured for inserting into a second gap defined by two layers of the substrate.

9. The device of claim 8, further including said third wedge and said second wedge being positioned singly proximate to said opposing ends of said first bar.

10. The device of claim 9, further including said third wedge being tapered such that a top surface of said third wedge is dimensionally larger than a bottom surface of said third wedge.

11. The device of claim 9, further including said third wedge being shaped complementarity to said first wedge.

12. The device of claim 1, further comprising:

a first plate coupled to and extending from a second end of said first rod, said first plate being configured to swivel relative to said first rod;

a second plate coupled to and extending from a respective said second bar such that said second plate is opposingly positioned relative to said first plate, said second plate being configured to swivel relative to said respective said second bar; and wherein said first plate is positioned on said first rod and said second plate is positioned on said respective said second bar such that said first plate and said second plate are configured for abutting the substrate as said first rod is compelled through said first channel to couple said C-clamp to the substrate.

13. The device of claim 12, further including said first plate and said second plate being circularly shaped.

14. The device of claim 1, further comprising:

said first wedge being tapered such that an outside surface of said first wedge is dimensionally larger than an inside surface of said first wedge; and said second wedge being tapered such that a lower surface of said second wedge is dimensionally larger than an upper surface of said second wedge.

15. The device of claim 1, further including said second wedge being positioned proximate to a respective said opposing end of said first bar.

16. A clamping and spreading device comprising: a C-clamp configured for fixedly coupling to a substrate, said C-clamp comprising: a first bar, a pair of second bars, each said second bar being coupled to and extending perpendicularly from a respective opposing end of said first bar such that said first bar and said pair of second bars are substantially C-shaped, a first channel positioned through a respective said second bar distal from said first bar, said first channel being parallel to said first bar, said first channel being internally threaded, and a first rod complementary to said first channel such that said first rod is selectively threadedly positionable within said first channel and selectively extendable from said respective said second bar, wherein said first rod is configured for rotating such that said first rod is compelled through said first channel to contact the substrate, wherein the substrate is coupled between said first rod and a respective said second bar;

a second channel positioned through said first rod proximate to a first end of said first rod, said second channel being positioned for selectively inserting a pin such that said pin extends perpendicularly from said first rod, wherein said second channel is positioned in said first rod such that said second channel is positioned for inserting said pin such that said pin is configured for grasping and twisting for compelling rotation of said first rod; a ball coupled to a terminus of said pin, wherein said ball is positioned on said pin such that said ball is positioned for contacting said first rod upon said pin being positioned through said second channel; a nut coupled to said first end of said first rod, said nut being complementary to a ratchet, wherein said nut is positioned on said first rod such that said nut is configured for coupling to the ratchet such that the ratchet is positioned for compelling rotation of said first rod;

a first plate coupled to and extending from a second end of said first rod, said first plate being configured to swivel relative to said first rod; a second plate coupled to and extending from a respective said second bar such that said second plate is opposingly positioned relative to said first plate, said second plate being configured to swivel relative to said respective said second bar, wherein said first plate is positioned on said first rod and said second plate is positioned on said respective said second bar such that said first plate and said second plate are configured for abutting the substrate as said first rod is compelled through said first channel to couple said C-clamp to the substrate, said first plate and said second plate being circularly shaped;

a second rod coupled to and extending from said C-clamp, said second rod being selectively extensible from said C-clamp;

a third channel, said third channel being positioned longitudinally in said first bar, said third channel extending from a respective said opposing end of said first bar, said second rod being positioned in and extensible from said third channel;

a first wedge coupled to and extending bidirectionally from said second rod distal from said C-clamp, said first wedge being tapered such that an outside surface of said first wedge is dimensionally larger than an inside surface of said first wedge;

a second wedge coupled to and extending from said C-clamp, wherein said first wedge is positioned on said second rod and said second wedge is positioned on said C-clamp such that said first wedge and said second wedge are configured for inserting into a first gap defined by two layers of the substrate, said second wedge being positioned proximate to a respective said opposing end of said first bar, said second wedge being tapered such that a lower surface of said second wedge is dimensionally larger than an upper surface of said second wedge;

an actuator coupled to said C-clamp, said actuator being operationally coupled to said second rod, wherein said actuator is positioned on said C-clamp such that said actuator is positioning for compelling said second rod to extend from said C-clamp, compelling said first wedge distally from said second wedge, such that the two layers of the substrate are separated, said actuator comprising a tube, said tube being rotationally coupled to said first bar, said tube being threadedly coupled to said second rod, wherein said tube is positioned on said first bar such that said tube is configured for rotating relative to said first bar, compelling said second rod through said third channel such that said first wedge is compelled distally from said C-clamp such that the layers of the substrate are separated, said tube being textured such that said tube is configured for grasping by a user for rotating said tube;

a third wedge coupled to and extending from said C-clamp, wherein said first wedge is positioned on said second rod and said third wedge is positioned on said C-clamp such that said first wedge and said third wedge are configured for inserting into a second gap defined by two layers of the substrate, said third wedge and said second wedge being positioned singly proximate to said opposing ends of said first bar, said third wedge being tapered such that a top surface of said third wedge is dimensionally larger than a bottom surface of said third wedge, said third wedge being shaped complementarily to said first wedge; and wherein said first plate is positioned on said first rod and said second plate is positioned on said respective said second bar such that said first plate and said second plate are configured for abutting the substrate as said first rod is compelled through said first channel to couple said C-clamp to the substrate, wherein said first wedge is positioned on said second rod and said second wedge is positioned on said C-clamp such that said first wedge and said second wedge are configured for inserting into the first gap defined by two layers of the substrate, wherein said first wedge is positioned on said second rod and said third wedge is positioned on said C-clamp such that said first wedge and said third wedge are configured for inserting into the second gap defined by the two layers of the substrate, wherein said tube is positioned on said first bar such that said tube is configured for rotating relative to said first bar, compelling said second rod through said third channel such that said first wedge is compelled distally from said C-clamp such that the layers of the substrate are separated.

* * * * *